US006039599A

United States Patent [19]

Benjamin et al.

[11] Patent Number: 6,039,599

[45] Date of Patent: Mar. 21, 2000

[54] SWITCH FOR A CARD READER ASSEMBLY

[75] Inventors: Karen Elizabeth Benjamin, Harrisburg; James Henry Hyland, Hummelstown, both of Pa.

[73] Assignee: The Whitaker Corporation, Wilmington, Del.

[21] Appl. No.: 09/106,437

[22] Filed: Jun. 29, 1998

Related U.S. Application Data

[60] Provisional application No. 60/051,322, Jun. 30, 1997.

[51] Int. Cl.[7] ..... H01R 3/00

[52] U.S. Cl. ..... 439/489; 439/630; 200/283

[58] Field of Search ..... 439/188, 489, 439/630, 631, 636, 632, 633, 634, 635, 637, 946; 200/51.09, 51.1, 51 R, 244, 335, 284, 272, 290, 283

[56] References Cited

U.S. PATENT DOCUMENTS

| | | | |
|---|---|---|---|
| 2,788,419 | 4/1957 | Young | 200/243 |
| 4,735,578 | 4/1988 | Reichardt et al. | 439/152 |
| 4,900,272 | 2/1990 | Lange et al. | 439/630 |
| 4,900,273 | 2/1990 | Pernet | 439/630 |
| 5,013,255 | 5/1991 | Juret et al. | 439/260 |
| 5,330,363 | 7/1994 | Gardner et al. | 439/188 |
| 5,334,034 | 8/1994 | Reichardt et al. | 439/188 |
| 5,334,827 | 8/1994 | Bleier et al. | 235/492 |
| 5,511,986 | 4/1996 | Casey et al. | 439/188 |
| 5,667,397 | 9/1997 | Broschard, III et al. | 439/188 |
| 5,718,609 | 2/1998 | Braun et al. | 439/630 |
| 5,811,744 | 9/1998 | Bartha | 200/5 A |

FOREIGN PATENT DOCUMENTS

| | | | |
|---|---|---|---|
| 2615161 | 5/1997 | Japan | H01R 23/68 |

OTHER PUBLICATIONS

Abstract and drawings for File No. 16793A, Ser. No. 09/013,860, filed Jan. 27, 1998, based on Provisional Application 60/045,189 filed Apr. 30, 1997 and 60/034,849 filed Jan. 29, 1997.

Abstract and drawings for file No. 16693, Ser. No. 08/935,553, filed Sep. 23,1997, based on Provisional Application 60/027,268 filed Sep. 26, 1996.

*Primary Examiner*—Paula Bradley
*Assistant Examiner*—Ross N. Gushi

[57] ABSTRACT

A switch 120 for a card reader assembly includes first and second terminals 122, 140 disposed in a card-receiving cavity 90. The first terminal 122 includes a board mounting section 124, a body portion 126 and a contact section 132 spaced from the board mounting section. The second terminal includes a board mounting section 142 at one end, a body section 144 and a switch portion 150 at an opposed end. Switch portion 150 has a card engaging end 152 and a contact engaging end 156 spaced therefrom and a fulcrum engaging portion 154 therebetween. The housing defines a fulcrum adapted to support the fulcrum engaging portion. Upon inserting a card 170 into the card receiving cavity 90, the card engages the card engaging end 152 of the second terminal causing the switch portion of the second terminal to pivot from one position to another providing an electrical signal indicating that the card 170 is fully inserted into the cavity 90.

8 Claims, 9 Drawing Sheets

SWITCH FOR A CARD READER ASSEMBLY

This appln claims the benefit of U.S. Provisional appln Ser. No. 60/051,322 filed Jun. 30, 1997.

FIELD OF THE INVENTION

This invention is directed to switches and more particularly to a switch for a card reader assembly.

BACKGROUND OF THE INVENTION

Card readers typically include a base and a cover defining a card receiving cavity and a plurality of data terminals extending into the cavity for engaging contact pads on the surface of a card. In some applications it is desirable that the assembly further include a switch, known in the art as an "end position switch", that indicates when a card has been fully inserted into the reader. U.S. Pat. Nos. 5,334,827 and 5,370,544 disclose end position switches.

SUMMARY OF THE INVENTION

The present invention provides a switch for a card reader assembly. The switch is disposed in a card receiving cavity and includes first and second terminals, the terminals being in one position when a card is in the cavity and an other position when the card is not in the cavity, ones of the positions being an engaged position and the other being a disengaged position. The first terminal includes a board mounting section at an end thereof, a body portion having a retention section and a contact section spaced from the board mounting section. The second terminal includes a board mounting section, a body portion having a retention section and a switch portion at an opposed second end. The switch portion of the second terminal has a card engaging end and a contact engaging end spaced therefrom and a fulcrum engaging portion therebetween. The contact engaging end is in a first position with respect to the contact section of the first terminal when no card is fully inserted into the cavity. The housing defines a fulcrum that is adapted to support the fulcrum engaging portion. Upon inserting a card into the card receiving cavity the card engages the card engaging end of the second terminal causing the switch portion of the second terminal to pivot to the second position with respect to the contact section of the first terminal thereby providing an electrical signal indicating that the card is fully inserted in the cavity. The terminals may be configured to be in an open or disengaged position when the card is not in the card-receiving cavity and a closed or engaged position when the card is fully inserted. Alternatively the terminals may be configured to be in a closed or engaged position when the card is not in the card-receiving cavity and an open or disengaged position when the card is fully inserted.

Embodiments of the invention will now be described with reference to the accompanying drawings.

DETAILED DESCRIPTION OF EMBODIMENTS OF THE INVENTION

Figure 1:
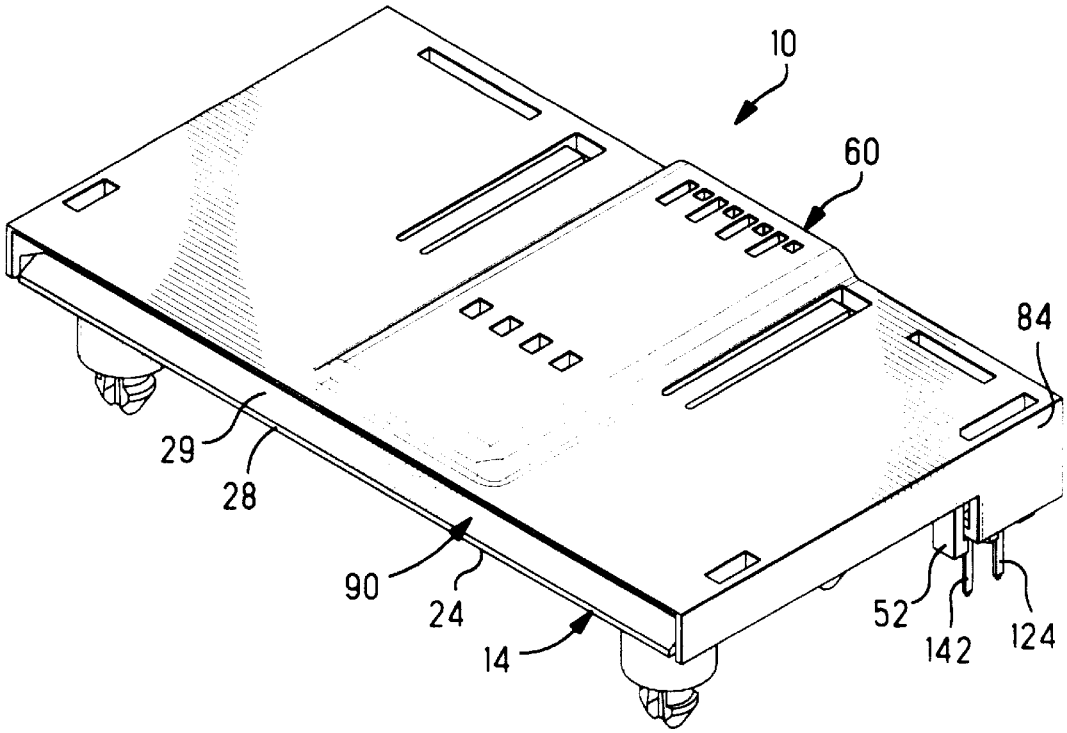
FIG. 1 is an isometric view of the card reader assembly made in accordance with the present invention.
Figure 4:
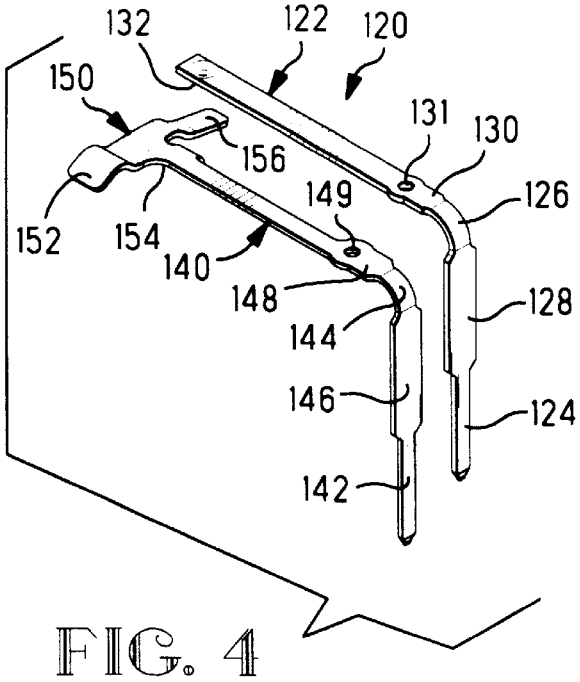
FIG. 4 is an isometric view of the two switching terminals of the present invention.
Figure 5:
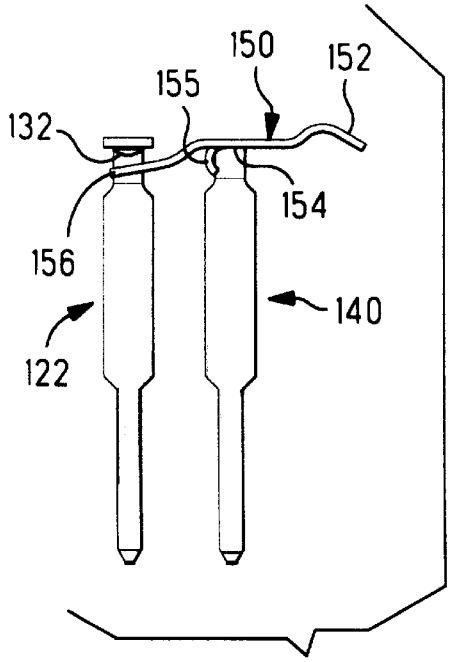
FIG. 5 is a side view of the terminals taken along line 5—5 of FIG. 3.
Figure 2:
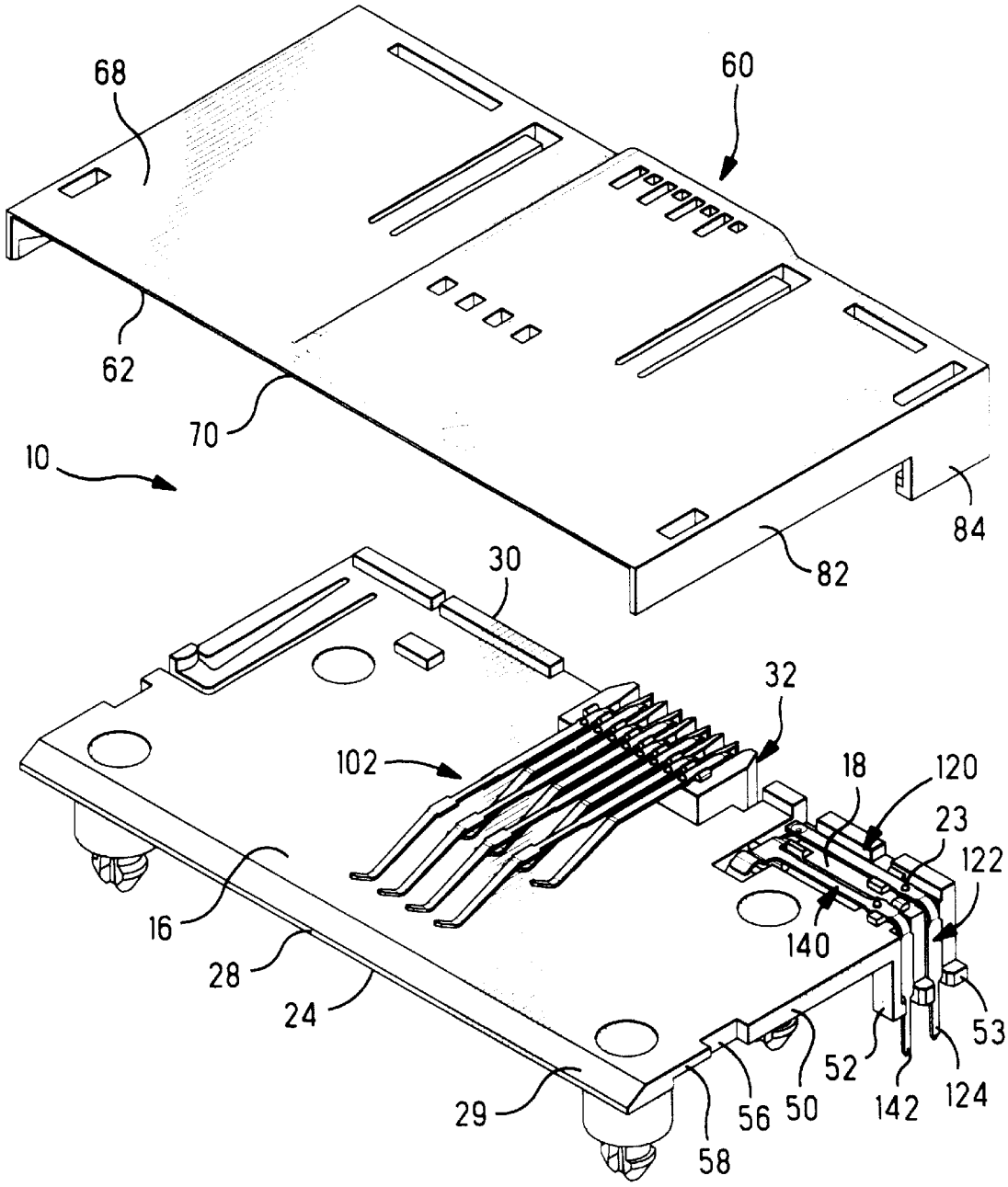
FIG. 2 is an isometric view of the assembly of FIG. 1 with the cover exploded from the base.

For purposes of illustrating the switch of the present invention, the switch will be shown in the card reader assembly disclosed in U.S. patent application Ser. No. 09/106,439, filed concomitantly herewith. It is to be understood that this switch can be used in other card reader assemblies.

Referring now to FIGS. 1 through 9, assembly 10 includes a base 14 and a cover 60 defining a card receiving cavity 90, a plurality of data terminals 102 and a switch 120. The base 14 includes inner and outer surfaces 16, 24, a forward face 28 having a lead-in surface 29, a rear wall 30 and sides 50. The data terminals 102 are disposed in a terminal housing having terminal-receiving section 32 in base 14 and a terminal securing portion 74 in cover 60. Further details of the structure of the card reader are disclosed in the previous referenced patent application.

Figure 3:
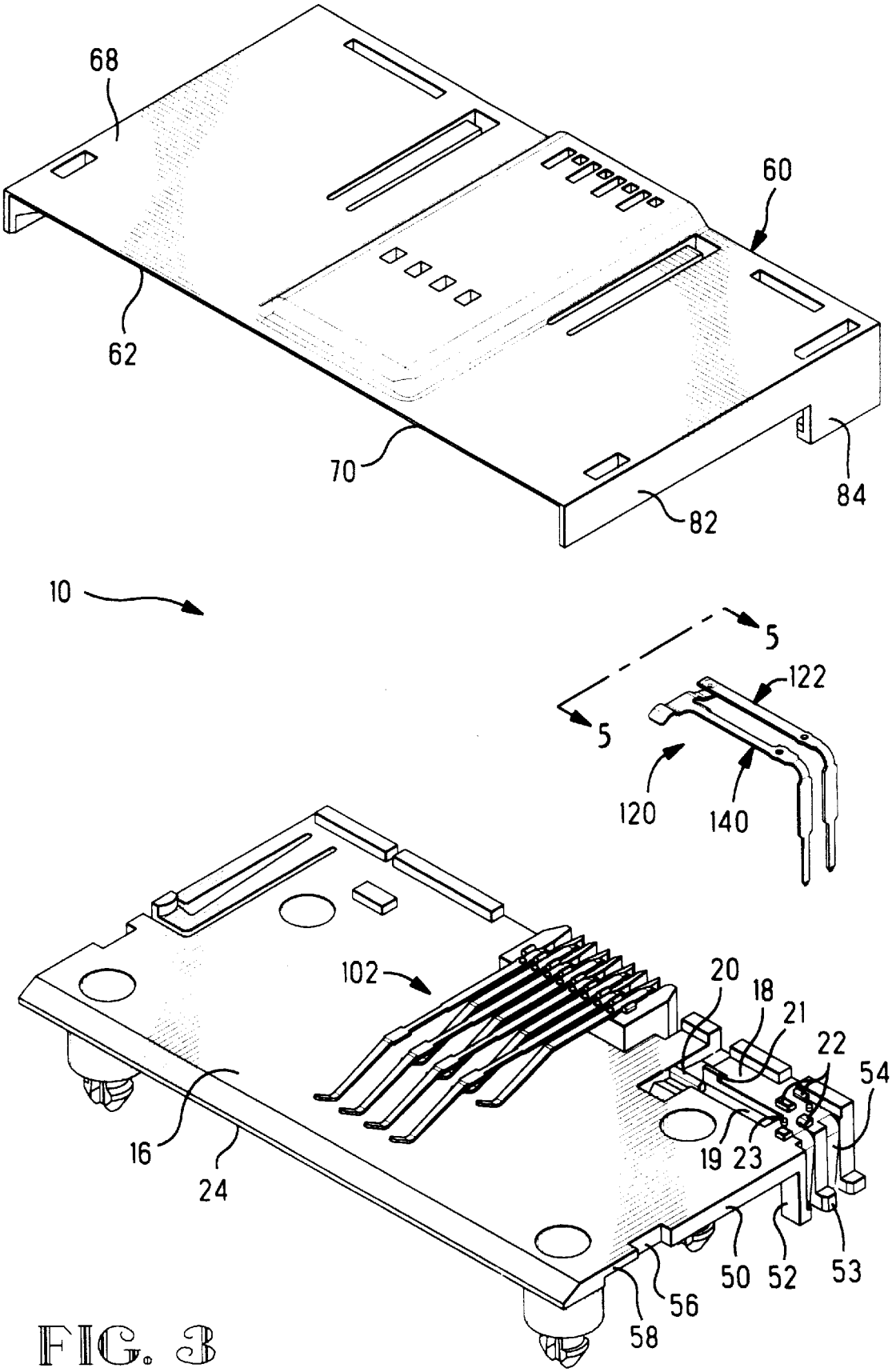
FIG. 3 is a further isometric view with the switch terminals exploded from the base.

Inner surface 16 of base 14 includes a switch 120 disposed in switch area 18. Switch area 18 includes an array of embossments 22 and a back-up wall 19 for securing the switch terminals 122, 140 in position and a raised portion 20 defining a fulcrum, as best seen in FIG. 3. The adjacent side 50 includes a downwardly directed switch-receiving portion 52 having two terminal receiving slots 54 defined therein for receiving the terminals 122, 140. The lower edges of switch receiving portion 52 include outwardly directed flanges 53.

Switch 120 includes a first terminal 122 and a second terminal 140. First terminal 122 includes a board mounting section 124 at an end thereof, a body section 126 having first or vertical portion 128 and second or horizontal portion 130 and a contact section 132 spaced from the board mounting section. Second terminal 140 includes a board mounting section 142, a body section 144 having a first or vertical portion 146 and a second or horizontal portion 148 and a switch portion 150. Switch portion 150 includes a card engaging end 152, and a contact engaging end 156 at an opposed second end, and a fulcrum engaging portion 154 therebetween. Switch 150 further includes a retention tab 155 proximate fulcrum engaging portion 154 that is adapted to engage a surface 21 of back-up wall 19 to prevent terminal 140 from moving laterally by the insertion force of the card. In the embodiment shown, switch 120 is open or disengaged when there is no card in the card-receiving cavity 90 and closed or engaged when a card 170 is in the card-receiving cavity 90.

Cover 60 includes inner and outer surfaces 62, 68, rear wall 72 and side walls 82 extending between a forward edge 70 and rear wall 72. One side wall 82 of cover 60 includes a switch-securing portion 84 extending downwardly therefrom. Upon assembling base 14 and cover 60 together switch-securing portion 84 cooperates with switch-receiving portion 52 to completely surround the vertical portions of the switch terminals.

Figure 6:
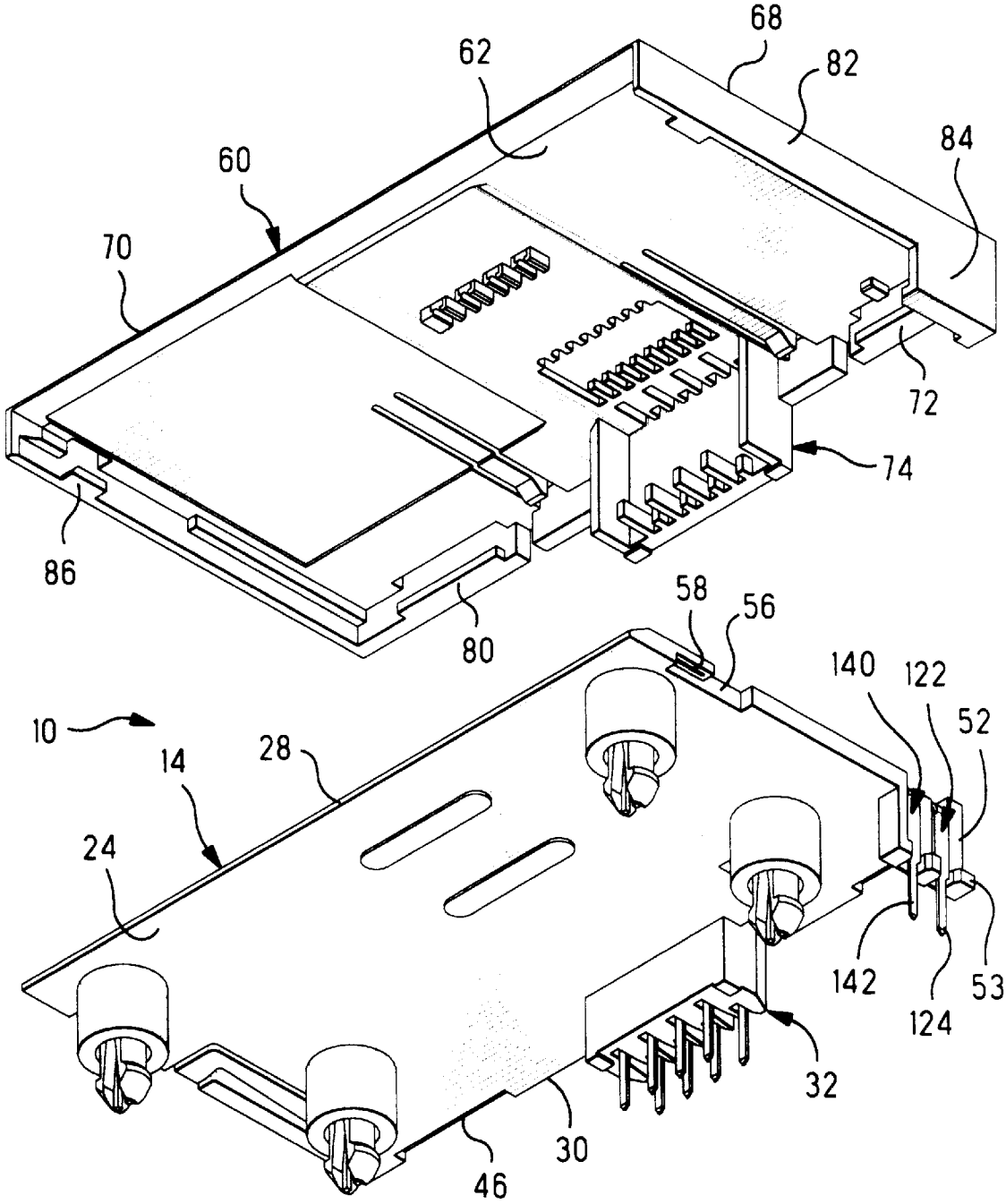
FIG. 6 is a view similar to that of FIG. 2 looking at the bottom of the assembly.
Figure 7:
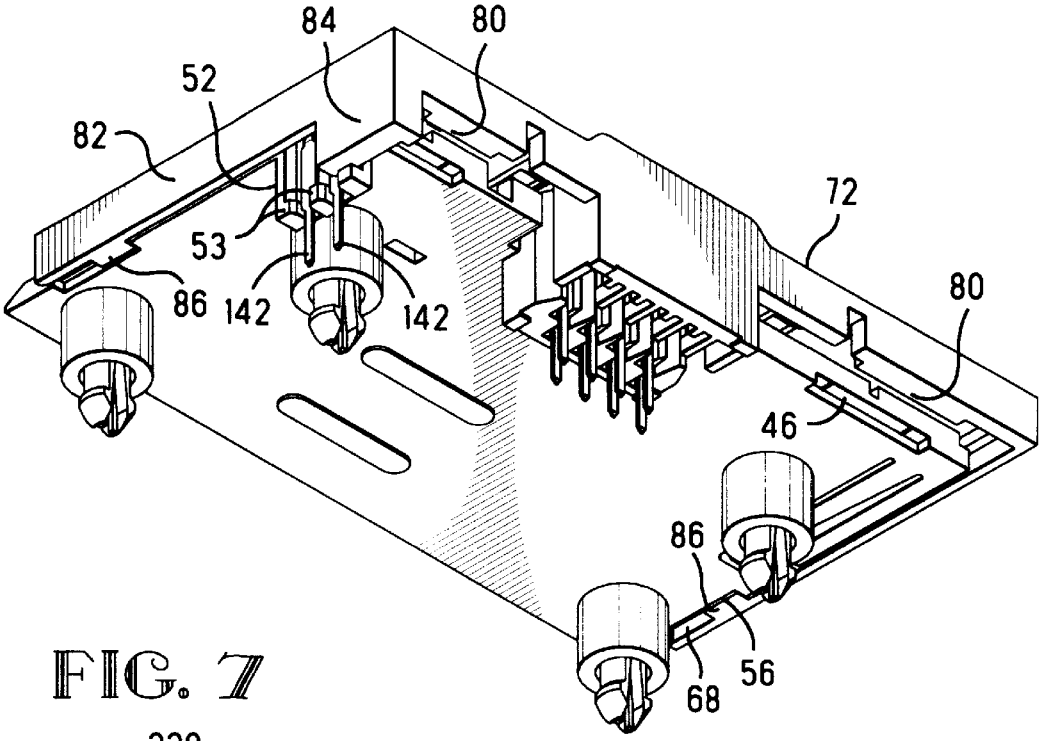
FIG. 7 is a partially assembled view of the assembly of FIG. 6.

First and second switch terminals 122, 140 are assembled in the card reader in the following manner. Terminals 122, 140 are right angle terminals that have horizontal portions 130, 148 of the respective body sections 126, 144 disposed along surface 16 of base 14 between respective embossments 22 and vertical portions 128, 146 disposed in respective slots 54 of switch-receiving portion 52. Terminal 140 lies adjacent back-up wall 19 with retention tab 155 engaging surface 21 of back-up wall 19 such that terminal 140 will not move laterally by force exerted by the card as it is inserted into cavity 90. The terminals 122, 140 are initially retained in the housing by disposing apertures 131, 149 in the respective horizontal body portions 130, 148 on corresponding protrusions 23 with the vertical body portions 128, 146 extending along slots 54, the board mounting sections 124, 142 extend outwardly between the flanges 53. The card reader, in the embodiment shown, is assembled by sliding the cover 60 forwardly such that the end of the switch-securing portion 84 is received along the outer surface of switch-receiving portion 52 and the end of switch-securing portion 84 is proximate the flanges 53, as shown in FIGS. 6 and 7. The card reader assembly includes cooperating flanges 86 and bosses 80 in cover 60 and flange-receiving openings and slots 56, 58 and recesses 46 in the base for securing the housing together as more fully described in U.S. patent application Ser. No. 08/984,612. When fully assembled, as shown in FIG. 1, the switch terminals 122, 140 are enclosed in the assembly with only the respective board mounting sections 124, 142 extending outwardly therefrom. It is to be understood that other means may be used for securing the terminals in either the base and/or cover. It is to be understood that other means for securing the cover and base together may be used with the switch.

Figure 8:
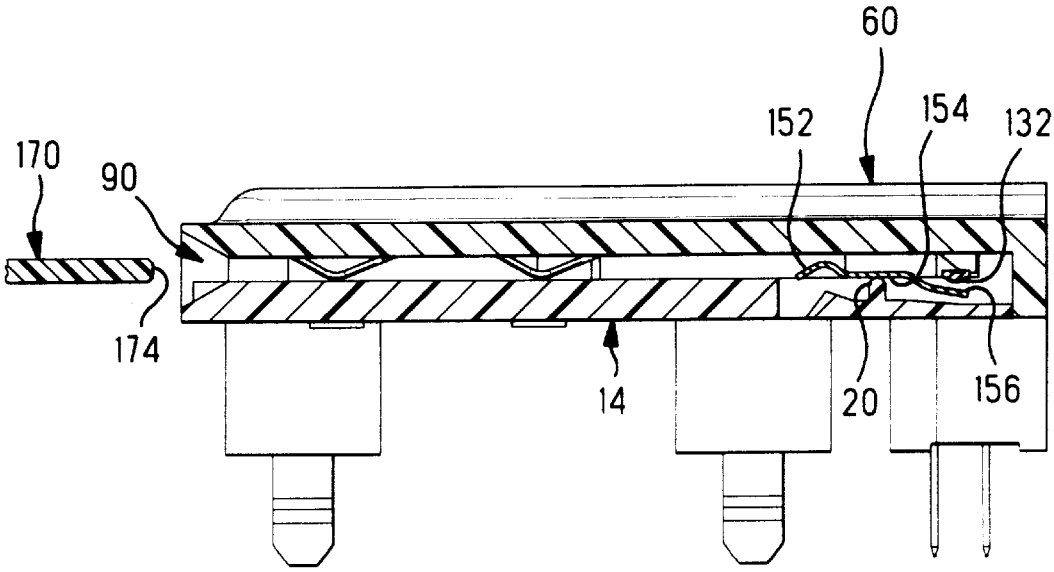
FIG. 8 is a cross-sectional view of the assembly prior to insertion of a card showing the switch in its disconnected position.
Figure 9:
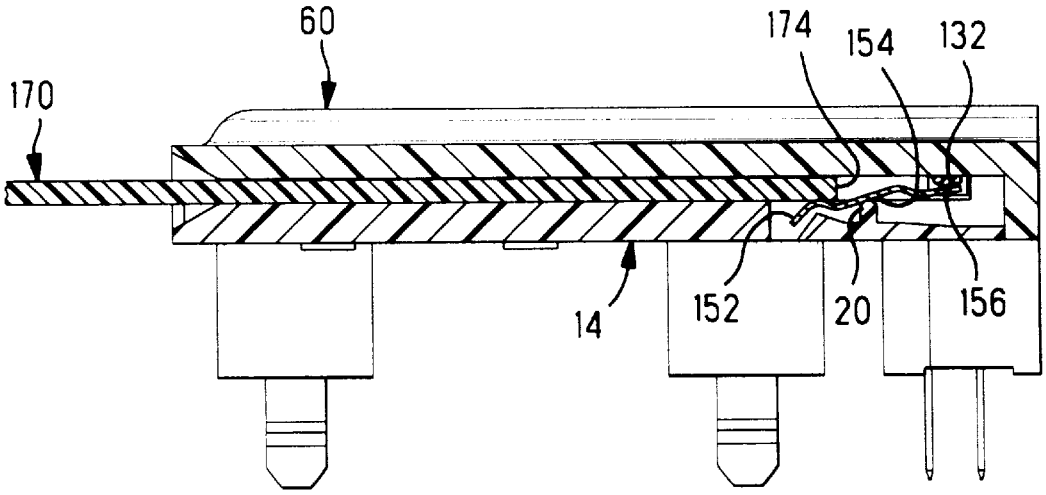
FIG. 9 is a view similar to that of FIG. 8 showing the switch in its connected position.

FIGS. 8, 9 show a cross-sectional view of the assembled card reader 10 illustrating how the switch 120 operates when a card 170 is inserted into card receiving cavity card 90. FIG. 8 illustrates the switch 120 prior to the insertion of card 170. The switch portion 150 of second terminal 140 is shown with the fulcrum engaging portion 154 positioned on the fulcrum 20 of the base 14 with the contact engaging end 156 spaced from the contact section 132 of first terminal 122. As the card 170 is inserted into the card receiving cavity 90 the leading end 174 engages the card engaging end 152 of terminal 140 depressing the end downwardly such that the fulcrum engaging portion 154 pivots on the fulcrum 20 and the contact engaging end 156 engages the contact section 132 of the first terminal 122.

Figure 11:
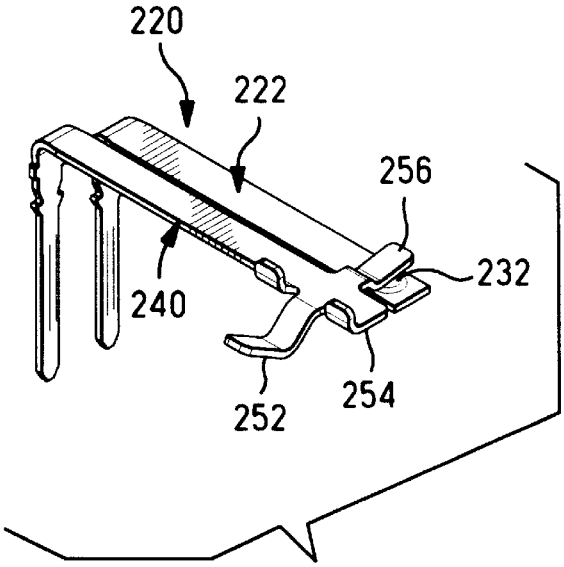
FIG. 11 is an isometric view of the alternative switch embodiment shown in FIG. 10.
Figure 12:
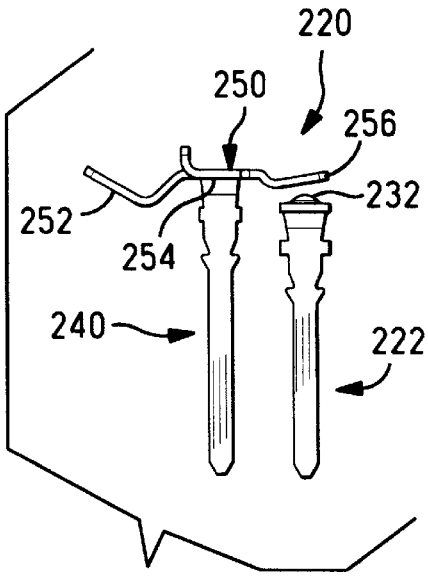
FIG. 12 is a side view of the terminals of FIG. 10.
Figure 10:
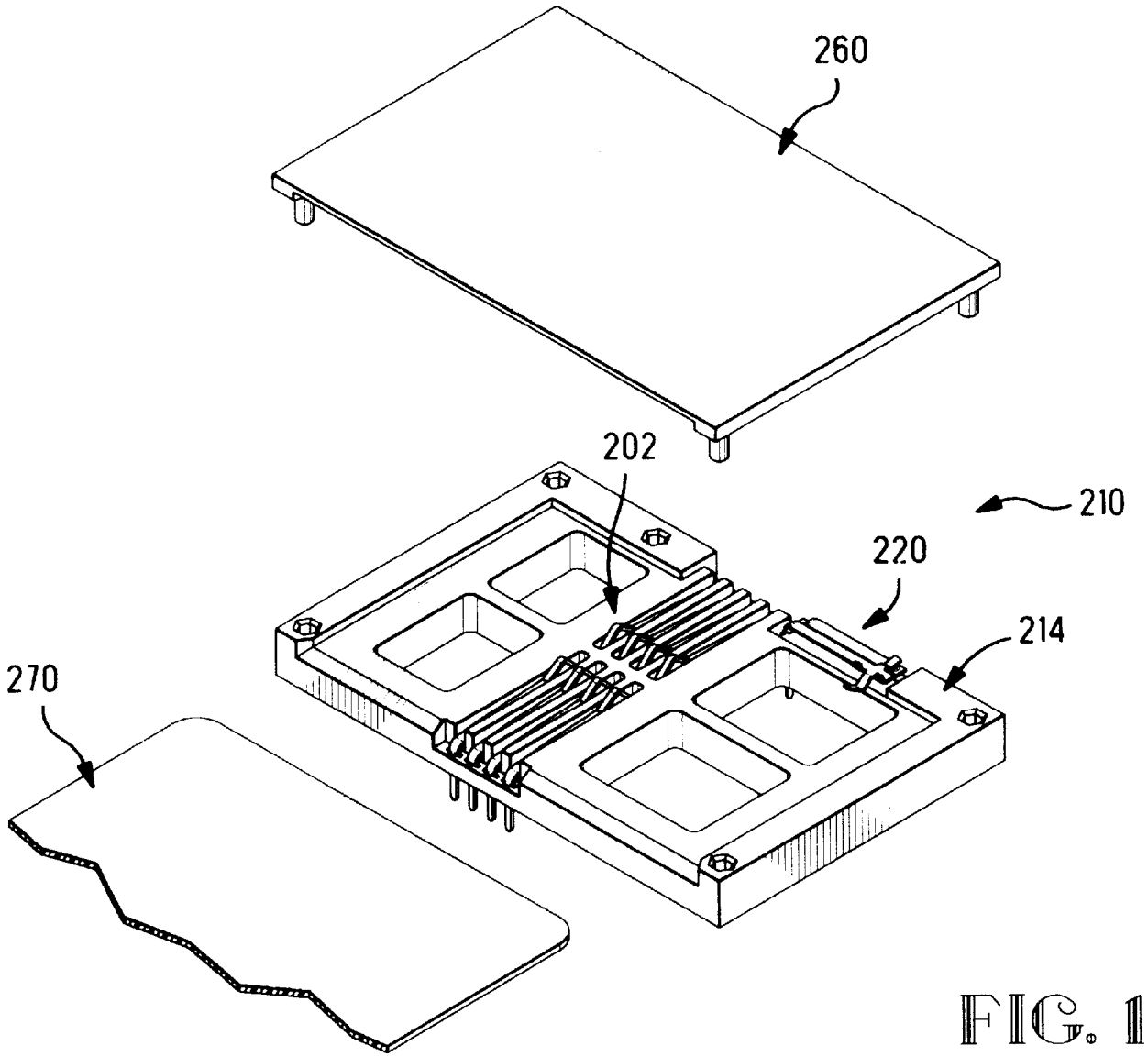
FIG. 10 is an isometric view of an alternative embodiment of the present invention.

FIGS. 10, 11, and 12 illustrate another embodiment 210 of a card reader having a base 214 and a cover 260 in which the data terminals 202 are disposed in the base 214 of the reader and the card 270 includes contact surfaces on the bottom surface thereof. Card reader 210 further includes switch 220, which has a different configuration than switch 120 previously described. In this embodiment, as shown by FIGS. 11 and 12, the card engaging portion 252 is raised such that the leading end of the card will cause the fulcrum engaging section 254 to pivot upwardly and the contact engaging surface 256 to pivot downwardly to engage a corresponding contact section 232 of a terminal 222.

Figure 13:
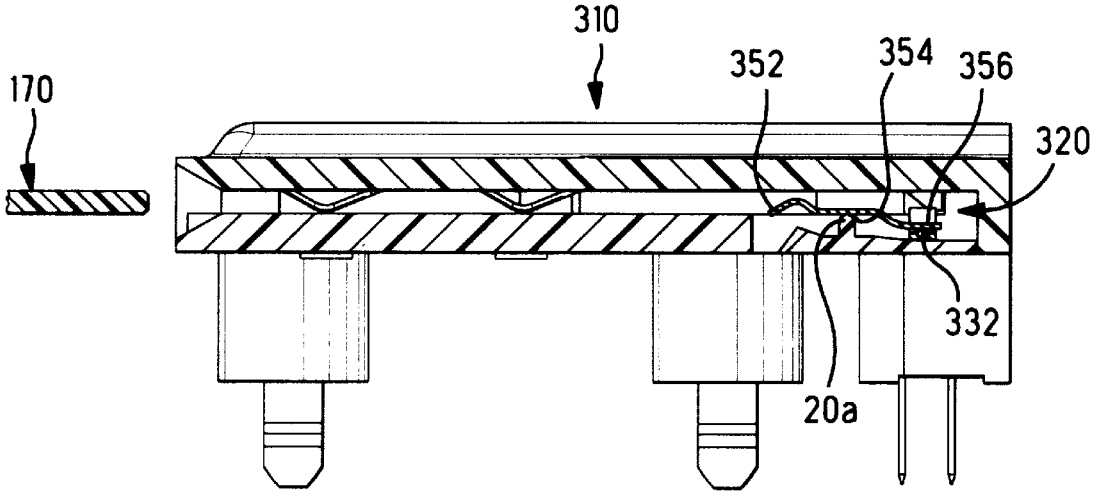
FIG. 13 is a partially sectioned view of the alternative switch embodiment shown in FIG. 10 showing the switch terminals in a first position when the card is not in the reader.
Figure 14:
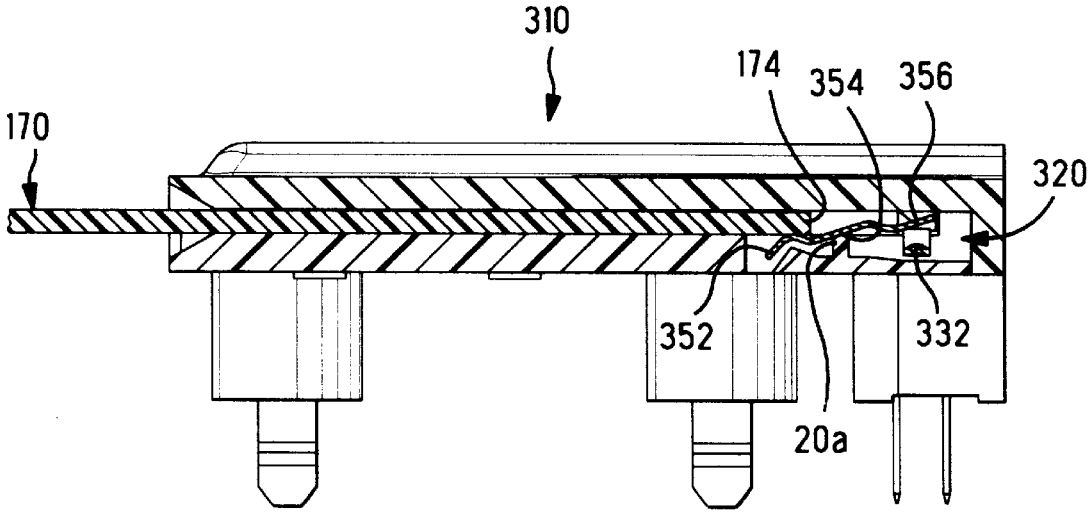
FIG. 14 is a view similar to that of FIG. 11, showing the position of the switch terminals when a card is in the reader.

FIGS. 13 and 14 show cross-sectional views of a card reader having an alternative embodiment 320 of the switch in which the switch is in a normally open position when there is no card in the reader and in a closed position when the card is inserted. In this embodiment the first terminal 322 is positioned in the housing such that contact section 332 is proximate the base 314. FIG. 13 illustrates the switch 320 prior to the insertion of card 170. The switch portion 350 of second terminal 340 is shown with the fulcrum engaging portion 354 positioned on the fulcrum 20*a* of the base 314 with the contact engaging end 356 engaged with contact section 332 of first terminal 322. As the card 170 is inserted into the card receiving cavity the leading end 174 engages the card engaging end 352 of terminal 340 depressing the end downwardly such that the fulcrum engaging portion 354 pivots on the fulcrum 20*a* and the contact engaging end 356 is raised upwardly disengaging end 356 from contact section 332.

Figure 15:
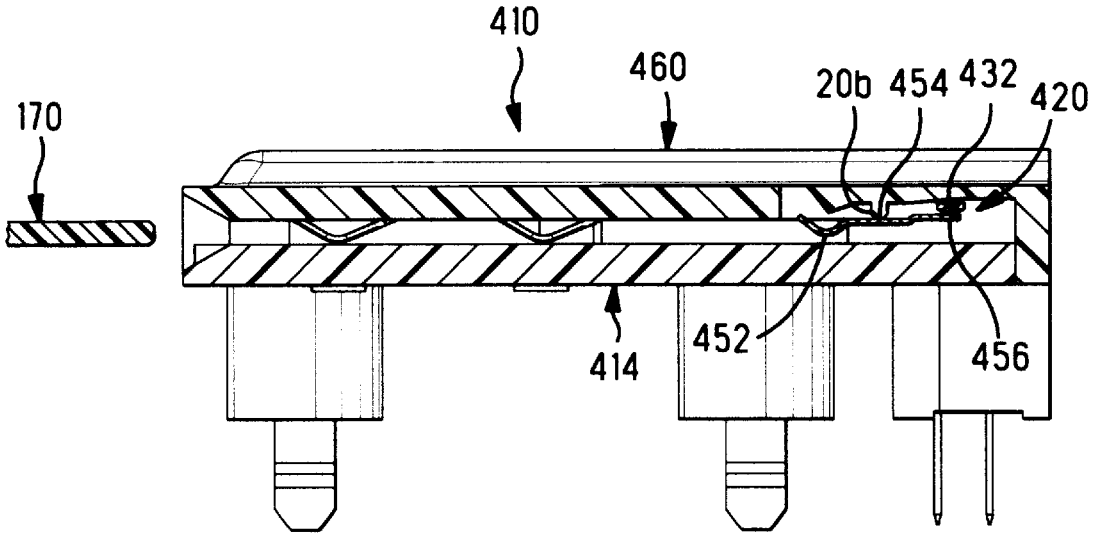
FIG. 15 is a partially sectioned view of a further alternative switch embodiment showing the switch terminals in a first position when the card is not in the reader.
Figure 16:
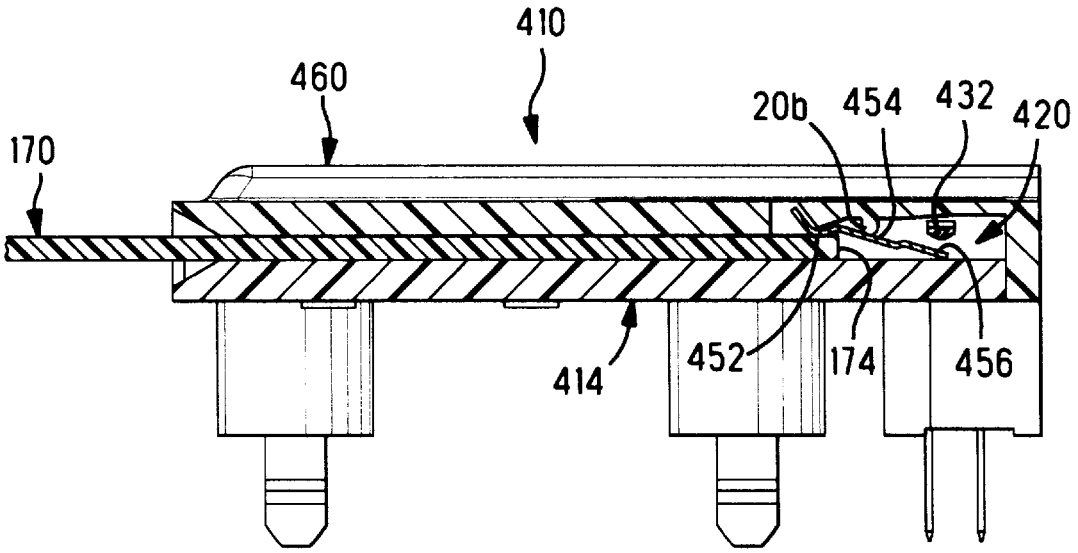
FIG. 16 is a view similar to that of FIG. 13, showing the position of the switch terminals when a card is in the reader of FIG. 13.

FIGS. 15 and 16 show cross-sectional views of a card reader having another alternative embodiment 420 of the switch in which the switch is in a normally open position when there is no card in the reader and in a closed position when the card is inserted. In this embodiment the first terminal 322 the fulcrum 20*b* is located on the cover 460 of the housing and the contact section 432 is also proximate the cover 460. FIG. 15 illustrates the switch 420 prior to the insertion of card 170. The switch portion 450 of second terminal 440 is shown with the fulcrum engaging portion 454 positioned on the fulcrum 204 of the cover 460 with the contact engaging end 456 engaged with contact section 432. As the card 170 is inserted into the card receiving cavity the leading end 174 engages the card engaging end 452 of terminal 340 raising the end upwardly such that the fulcrum engaging portion 454 pivots on the fulcrum 20*b* and the contact engaging end 456 is pivoted downwardly disengaging end 456 from contact section 432.

It is to be understood that any of the embodiments 120, 220, 320, 420 of the switch may be used in card readers having top mounted or bottom mounted terminals.

It is thought that the switch of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A switch for a card reader assembly including a housing having a card receiving cavity, said switch being disposed in said cavity, said switch including first and second terminals, said terminals being in one position when a card is in said cavity and in an other position when said card is not in said cavity, said switch comprising:

said first terminal including a board mounting section at an end thereof, a body portion having a retention section and a contact section spaced from the board mounting section;

said second terminal including a board mounting section at one end, an intermediate portion having a retention section and a switch portion at an opposed second end, said switch portion having a card engaging end and a contact engaging end spaced therefrom and a fulcrum engaging portion therebetween, said contact engaging end being in said one position relative to said contact section of said first terminal;

said housing defines a fulcrum adapted to support said fulcrum engaging portion of said second terminal;

whereby, upon inserting a card into said card receiving cavity, said card engages said card engaging end of said second terminal causing said fulcrum engaging portion of said second terminal to pivot about said fulcrum thereby moving said switch portion to said other position relative to said contact section of said first terminal, providing an electrical signal indicating that said card is fully inserted into said cavity.

2. The switch for a card reader assembly of claim 1 wherein said terminals are electrically disengaged when they are in said one position, defining a normally open switch and are electrically engaged when they are in said other position.

3. The switch for a card reader assembly of claim 1 wherein said terminals are electrically engaged when they are in said one position, defining a normally closed switch and are electrically disengaged when they are in said other position.

4. The switch for a card reader assembly of claim 1 wherein said board mounting sections of the first and second terminals are proximate each other.

5. The switch for a card reader assembly of claim 1 wherein said housing defines a fulcrum in a base of said housing.

6. The switch for a card reader assembly of claim 1 wherein said housing defines a fulcrum in a cover of said housing.

7. A switch for a card reader assembly including a housing having a card receiving cavity, said switch being disposed in said cavity, said switch including first and second terminals, said terminals being engaged when a card is in said cavity and disengaged when said card is not in said cavity, said switch comprising:

said first terminal including a board mounting section at an end thereof, a body portion having a retention section and a contact section spaced from the board mounting section;

said second terminal including a board mounting section at one end, an intermediate portion having a retention section and a switch portion at an opposed second end, said switch portion having a card engaging end and a contact engaging end spaced therefrom and a fulcrum engaging portion therebetween, said contact engaging end being disengaged from said contact section of said first terminal when no card is fully inserted into said cavity;

said housing defines a fulcrum adapted to support said fulcrum engaging portion of said second terminal;

whereby, upon inserting a card into said card receiving cavity, said card engages said card engaging end of said second terminal causing said fulcrum engging portion of said second terminal to pivot about said fulcrum thereby moving said switch portion into engagement with said contact section of said first terminal, closing an electrical circuit and indicating that said card is in position in said cavity.

8. A switch for a card reader assembly including a housing having a card receiving cavity, said switch being disposed in said cavity, said switch including first and second terminals, said terminals being disengaged when a card is in said cavity and engaged when said card is not in said cavity, said switch comprising:

said first terminal including a board mounting section at an end thereof, a body portion having a retention section and a contact section spaced from the board mounting section;

said second terminal including a board mounting section at one end, an intermediate portion having a retention section and a switch portion at an opposed second end, said switch portion having a card engaging end and a contact engaging end spaced therefrom and a fulcrum engaging portion therebetween, said contact engaging end being engaged with said contact section of said first terminal when no card is fully inserted into said cavity;

said housing defines a fulcrum adapted to support said fulcrum engaging portion of said second terminal;

whereby, upon inserting a card into said card receiving cavity, said card engages said card engaging end of said second terminal causing said fulcrum engaging portion of said second terminal to pivot about said fulcrum thereby causing said switch portion to become disengaged from said contact section of said first terminal, opening an electrical circuit and indicating that said card is in position in said cavity.

* * * * *